US005715748A

United States Patent [19]

Murakami et al.

[11] Patent Number: 5,715,748

[45] Date of Patent: Feb. 10, 1998

[54] SQUEEGEE FOR SCREEN PRINTING MACHINE

[75] Inventors: Takehiko Murakami; Kunio Kondo, both of Tokyo, Japan

[73] Assignee: Minami Engineering Co., Ltd., Japan

[21] Appl. No.: 712,268

[22] Filed: Sep. 11, 1996

Related U.S. Application Data

[63] Continuation-in-part of Ser. No. 518,727, Aug. 24, 1995, abandoned, which is a continuation of Ser. No. 252,654, Jun. 1, 1994, abandoned.

[30] Foreign Application Priority Data

Jul. 22, 1993 [JP] Japan ..... 5-044367 U

[51] Int. Cl.[6] ..... B41F 15/42; B41F 15/44

[52] U.S. Cl. ..... 101/114; 101/120

[58] Field of Search ..... 101/120, 123, 101/124, 114, 115, 116

[56] References Cited

U.S. PATENT DOCUMENTS

| | | | |
|---|---|---|---|
| Re. 30,143 | 11/1979 | Vertegaal | 101/120 |
| 4,078,486 | 3/1978 | Moser | 101/120 |
| 4,232,601 | 11/1980 | Mitter | 101/120 |
| 4,242,401 | 12/1980 | Mitani et al. | 101/127 |
| 5,483,879 | 1/1996 | Tani et al. | 101/120 |
| 5,524,540 | 6/1996 | Van Denend | 101/169 |

FOREIGN PATENT DOCUMENTS

| | | | |
|---|---|---|---|
| 964923 | 3/1975 | Canada | 101/120 |
| 1577451 | 8/1969 | France | 101/337 |

OTHER PUBLICATIONS

Tamas Frecska, "Introducing 'The Squeegee'", Screen Printing Magazine, pp. 100–102, 126–128, Apr. 1984.

*Primary Examiner*—Edgar S. Burr
*Assistant Examiner*—Daniel J. Colilla

[57] ABSTRACT

A squeegee assembly for a screen printing machine is provided comprising a squeegee body formed of a resilient material and an attached thin flexible polished metal plate, said plate attached to and supported by a front face of said squeegee body in a linear manner, a bottom end of said flexible plate projecting from a bottom end of said squeegee body, and support means supporting said squeegee body and attached flexible plate in an inclination angle of 60°~70° relative to a direction of movement of said squeegee.

3 Claims, 2 Drawing Sheets

SQUEEGEE FOR SCREEN PRINTING MACHINE

CROSS-REFERENCE TO RELATED APPLICATIONS

The present application is a continuation-in-part of Ser. No. 08/518,727, filed Aug. 24, 1995, now abandoned, which is a continuation of Ser. No. 08/252,654, filed Jun. 1, 1994, now abandoned.

BACKGROUND OF THE PRESENT INVENTION

The present invention relates to a squeegee for a screen printing machine.

In general, a squeegee for a screen printing machine is made of polyurethane rubber, in particular, hard polyurethane rubber. Accordingly, the frictional resistance of the squeegee is quite high, and it is likely that when the squeegee is slidingly moved on and along a mask, the latter would be caused to roll up and assume a wavy appearance. This causes a non-uniformity during printing. In addition, it is becomes difficult to apply paste such as cream solder, adhesives, ink and the like to a predetermined position of a printed matter such as a print substrate.

SUMMARY OF THE INVENTION

In view of the foregoing defects, an object of the present invention is to provide a squeegee for a screen printing machine which exhibits reduced frictional resistance by employing a thin metal plate in a position of contact between the mask and the squeegee.

According to the present invention, in order to attain this and other objects, there is provided a squeegee for a screen printing machine comprising a squeegee body formed of a resilient material such as rubber having a thickness of about 6 to 9 mm, and attached thereto a thin flexible polished metal plate with a thickness of about 0.1 to 0.2 mm, said plate attached to and supported by a front face of said squeegee body in a linear manner, a bottom edge of said flexible metal plate extending from a bottom edge of said squeegee body by a distance of about 0.1 to 0.65 mm, and support means supporting said squeegee body and attached flexible plate in a given inclination angle of about 60° to 70° relative to a direction of movement of said squeegee.

According to the present invention, during use the portion of the thin metal plate projecting from the bottom of the squeegee body is caused to contact the mask. As metal has a lower frictional resistance than that of rubber, the overall frictional resistance is lowered. Also, the thin metal plate is made very thin (i.e., having a thickness of about 0.1 mm) to thereby reduce the frictional resistance. Accordingly, when the squeegee is slidingly moved on and along the mask, the frictional resistance exhibited is very low thus solving the problems inherent during use of conventional squeegees.

Also, since the metal plate is very thin as mentioned above, it exhibits desirable flexibility or resiliency, and since the supporting squeegee body portion positioned behind the metal plate is made of rubber and exhibits certain inherent resiliancy and flexibility, in the case where the face of the mask has an irregular surface, the metal plate is able to follow and conform to the irregular surface of the mask to the extent that the flexible squeegee body is caused to be deformed.

DESCRIPTION OF THE PREFERRED EMBODIMENTS

Figure 1:
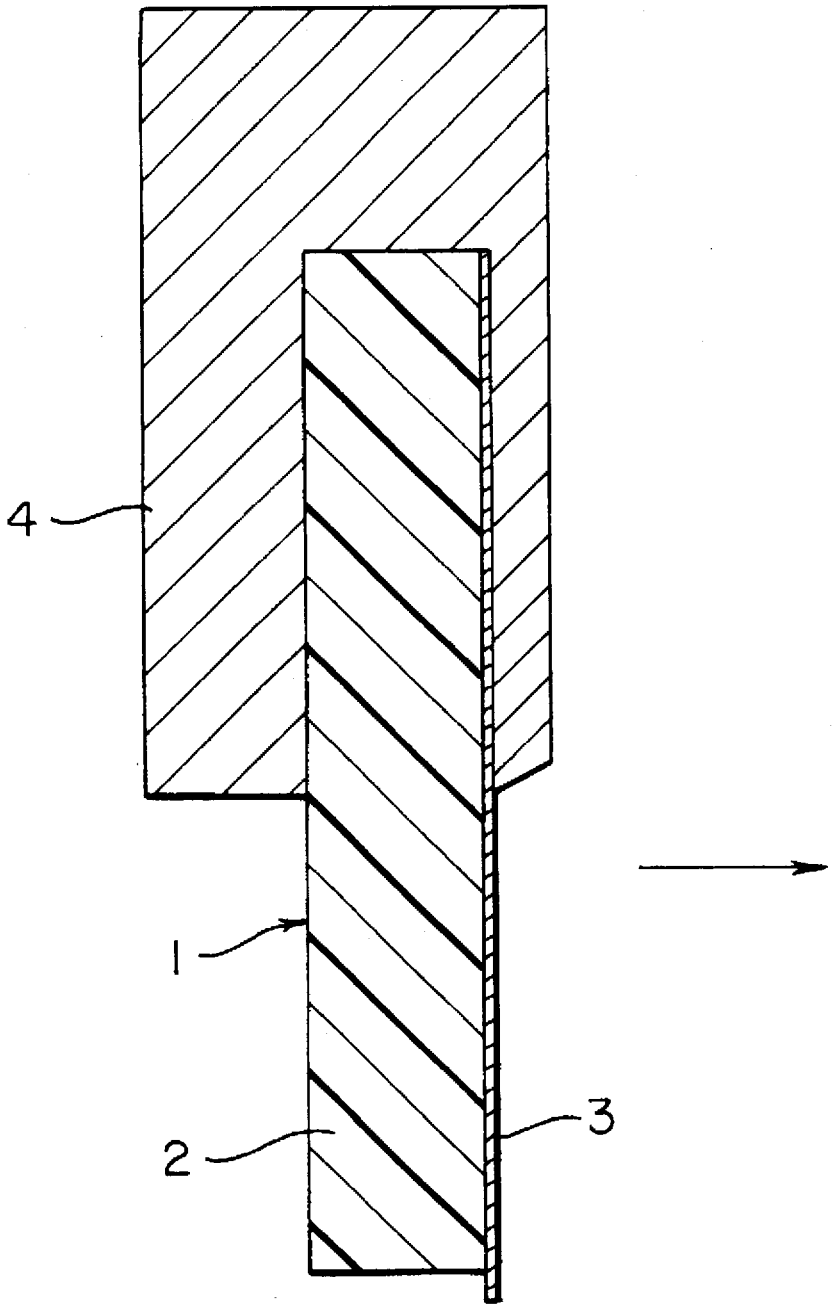
FIG. 1 is a cross-sectional view showing one embodiment of a squeegee body held by a squeegee holder in accordance with the present invention.

The present invention will now be described with reference to the drawings. In FIG. 1 a squeegee 1 is made of a squeegee body 2 and a thin metal plate 3. The squeegee body 2 is made of hard polyurethane rubber and the thin metal plate 3 is attached to a front face of the squeegee body 2 in the moving direction thereof. The thin metal plate 3 is made of stainless steel in the embodiment shown. Also, it is preferable that the thickness of the thin metal plate is about 0.1 mm, and the thin metal plate projects by about 0.50 mm from a lower end of the squeegee body 2. It is also preferable that burr is removed off from the thin metal plate 3 by electrolytic polishing. A squeegee holder 4 holds the squeegee 1.

Since the squeegee is constructed as mentioned above and the thin metal plate is attached to and extends from the squeegee body in a manner which permits contact with the mask, it is possible to considerably reduce the frictional resistance therebetween. Accordingly, it is possible to overcome the defects inherent in conventional squeegees. Also, since the metal plate is made thin and has a flexibility or resiliency, and the squeegee body behind the metal plate is made of rubber, in the case where the surface of the mask is irregular, the metal plate is able to follow and conform to the irregular surface of the mask.

Figure 2:
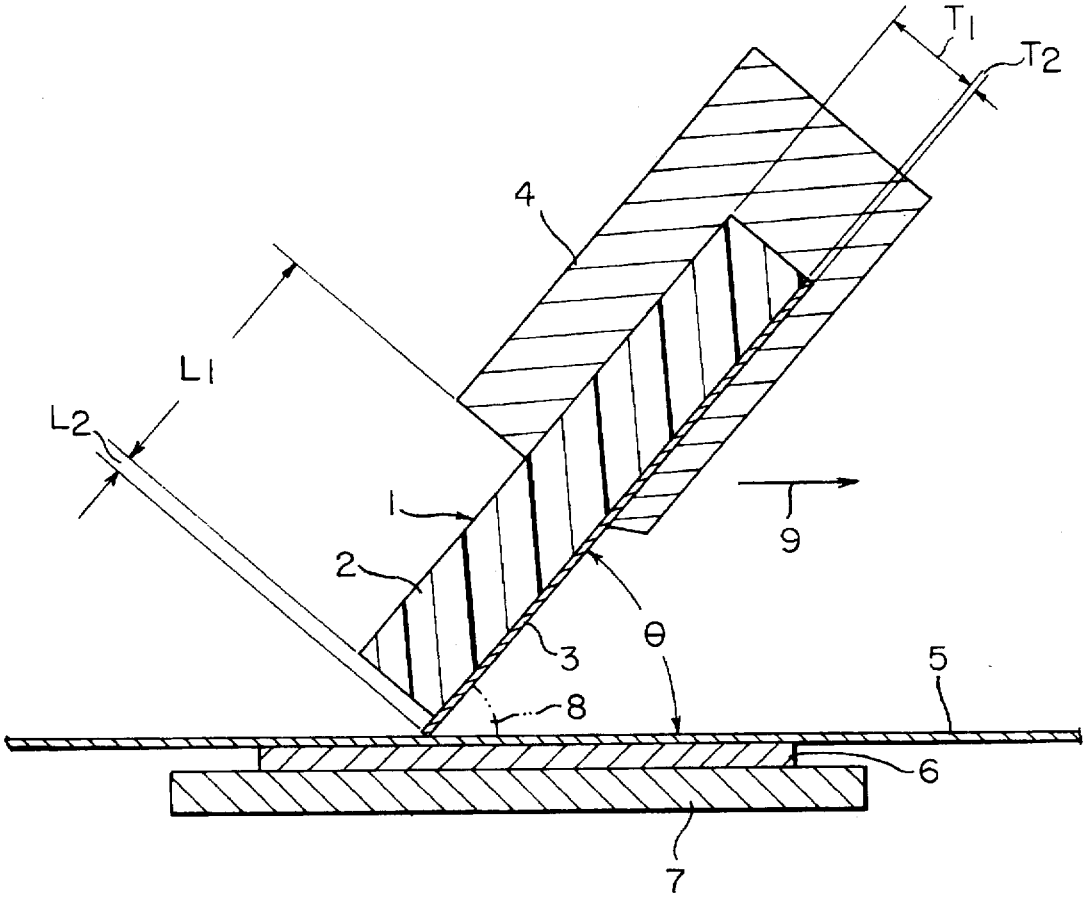
FIG. 2 is a cross-sectional view of another embodiment of the squeegee in accordance with the present invention.

FIG. 2 depicts another embodiment of a squeegee in accordance with the present invention. The reference numbers 1 to 4 in FIG. 2 reference the same elements as those shown in FIG. 1. In FIG. 2, a substrate 6 is disposed on a base 7 and a metal mask 5 is positioned on the substrate 6.

The squeegee 1 comes into contact with the metal mask 5 by a slant angle θ (preferably, about 60° to 70°) relative to the mask 5 and is moved in a direction shown by an arrow 9. At this time, a paste 8 such as a creamy solder, an ink or the like, which is deposited on the mask 5 adjacent to the metal plate 3, is squeezed through patterns (not shown) in the metal mask 5 onto the substrate 6 on the base 7 by the squeegee 1.

The dimensions of each part illustrated in FIG. 2 are as follows:

A thickness T1, of the squeegee body 2 made of a urethane rubber is about 6 mm, a thickness $T_2$ of the thin metal plate 3 made of a stainless steel (SUS) is about 0.1 mm, a projecting length $L_2$ of the metal plate 3 is about 0.1 mm, and a projecting length $L_1$ of the squeegee body 2 is about 14 mm.

It should be noted that the present invention is not limited to the above dimensions, but that dimensions within the following ranges may be employed:

$T_1$=about 6 to 9 mm $T_2$=about 0.1 to 0.2 mm $L_1$=about 13 to 17 mm $L_2$=about 0.1 to 0.65 mm In this embodiment, the squeegee 1 made of an assembly comprising a urethane rubber body and an attached stainless steel plate minimizes wear by means of a slight projection of the stainless steel plate while maintaining a resiliency of the urethane rubber, can assist the paste 8 in rolling on the metal mask 6, and can prevent the paste 8 from spreading on the rear side of the mask 6.

Since the squeegee 1 exhibits the resiliency of the urethane rubber, it is possible to print under a low pressure sufficient to hold particles of the paste in position, thereby obtaining a good printing appearance.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A squeegee assembly for a screen printing machine comprising:

a squeegee body having proximal and distal ends, said body formed of a resilient material having a thickness of about 6 to 9 mm;

a thin flexible polished metal plate having proximal and distal ends, said plate having a thickness of 0.1 to 0.2 mm, said plate attached to and supported by a front face of said squeegee body in a linear manner, a bottom edge at the distal end of said plate extending below a bottom edge at the distal end of said squeegee body by a distance of about 0.1 to 0.65 mm, said portion of said plate extending below the bottom edge of said squeegee body being coplanar with said supported portion of said metal plate and, support means for supporting the proximal ends of said squeegee body and said metal plate in a given inclination angle of about 60° to 70° relative to a direction of movement of said squeegee, the distal end of said squeegee body extending below said support means by a distance of about 13 to 17 mm.

2. The squeegee according to claim 1, wherein said thin metal plate is made of stainless steel.

3. The squeegee according to claim 1, wherein said rubber material is polyurethane rubber.

* * * * *

UNITED STATES PATENT AND TRADEMARK OFFICE

CERTIFICATE OF CORRECTION

PATENT NO. : 5,715,748

DATED : February 10, 1998

INVENTOR(S) : Murakami et al.

It is certified that error appears in the above-indentified patent and that said Letters Patent is hereby corrected as shown below:

Claim 1, column 4, line 6, "plate and"
should read -- plate; and,--.

Claim 3, column 4, line 15, "rubber"
should read -- resilient --.

Signed and Sealed this

Eighteenth Day of August, 1998

Bruce Lehman

*Attest:*

BRUCE LEHMAN

*Attesting Officer*

*Commissioner of Patents and Trademarks*